US005251870A

United States Patent [19]

Ward

[11] Patent Number: 5,251,870

[45] Date of Patent: Oct. 12, 1993

[54] BLOWOUT PREVENTER RAM PACKER AND WEAR INSERT

[75] Inventor: Michael W. Ward, Houston, Tex.

[73] Assignee: H & H Rubber, Inc., Houston, Tex.

[21] Appl. No.: 888,912

[22] Filed: May 26, 1992

[51] Int. Cl.[5] ..... E21B 33/06

[52] U.S. Cl. ..... 251/1.3; 277/129

[58] Field of Search ..... 251/1.1, 1.3; 277/129, 277/165, 181, 227

[56] References Cited

U.S. PATENT DOCUMENTS

| | | | |
|---|---|---|---|
| 3,434,729 | 3/1969 | Shaffer et al. | 251/1.3 X |
| 4,398,729 | 8/1983 | Bishop et al. | 251/1.3 X |
| 4,541,639 | 9/1985 | Williams, III | 251/1.3 X |
| 4,825,948 | 5/1989 | Carnahan | 251/1.3 X |
| 5,127,623 | 7/1992 | McDugle | 251/1.3 |

*Primary Examiner*—John C. Fox

*Attorney, Agent, or Firm*—Kenneth H. Johnson

[57] ABSTRACT

A ram packer for a hydraulic blowout preventer is provided that includes a steel reinforced hard elastomeric body which has a recess in the packer face for receiving a replaceable wear insert. The wear insert includes a substantially square insertion surface which corresponds to the recess in the packer surface. The substantially square insertion surface prevents rotation of the wear insert when it engages a rotating pipe passing through the blowout preventer. The wear insert may be made of various materials according to the service in which used.

20 Claims, 4 Drawing Sheets

BLOWOUT PREVENTER RAM PACKER AND WEAR INSERT

BACKGROUND OF THE INVENTION

1. Field of the Invention

The present invention relates to ram type blowout preventers which are hydraulically activated to seal about a pipe string of an oil or gas well to confine and control the pressure therein. More particularly the invention relates to replaceable wear inserts which seal about the pipe and which may be replaced when worn, thus saving the ram for further use. Most particularly the invention relates to replaceable wear inserts for use with heavy rubber ram packers.

2. Related Art

There are many styles of ram type blowout preventers available. One style, as illustrated in U.S. Pat. No. 4,825,948 issued to Carnahan comprises a ram body with a remotely replaceable shoe assembly, the sealing surface being integral with the shoe. The patent discloses ram shoes that are remotely removable and replaceable and includes a good background discussion of blowout preventers in general.

Generally in a very common ram a wear insert is placed in a semicircular cutout on the face of a ram front body. The body of such a ram is usually of a heavy rubber material and the wear insert of an elastomeric material such as TEFLON or high molecular weight polyethylene. The wear insert of this common ram is a very simple semi-circular piece of the elastomeric material with the sealing surface and the insertion surface being parallel. The wear insert may be retained within the ram packer by radial fasteners such as screws. The problem with such an arrangement is that if the opposing ram packers seat at different times around the pipe the wear insert in all likelihood will be twisted out of the cutout by the rotating pipe even when the radial fasteners are used. U.S. Pat. No. 4,323,256 discloses a arcuate insert made of a material having reduced friction.

Another type of blowout preventer is illustrated in U.S. Pat. No. 4,541,639 issued to Williams which comprises a ram body with a ram front packing including a backing portion of elastomeric material and a replaceable insert portion also of an elastomeric material. The wear insert is shaped to include lips that fit into matching slots in the recess. The top and bottom surfaces of the backing portion and insert portion are held together by plates. The insert is tightly engaged with the backing portion and may be removed and replaced only by disengaging and removing the packer from the ram apparatus. To remove the insert from the packer one or both plates are removed and the insert slid axially along seating grooves in the packer. The necessary tightness of fit would probably require that the wear insert therein be driven out of the ram packer from the top or bottom.

A similar arrangement is disclosed in U.S. Pat. No. 4,398,729 issued to Bishop, et al. As in the Williams patent, the Bishop, et al, patent also utilizes metal plates to strengthen the backing portion which with securing members projecting from the insets and cooperating receptacles hold the wear insert in place. Additionally the wear insert of U.S. Pat. No. 4,398,729 includes a pair of securing members extending from the sides to prevent rotation. In column 4 at lines 22–27, the patentee notes that the shape of the insert that fits in the detent on the ram packer can have any configuration in addition to the semi-circular shape shown, so long as the detent in the packer corresponds therewith. The specific configurations mentioned are rectangular and multi-sided. The point of the incidental mention of the insert shape was to prevent a narrow construction of the invention to an insert held in place by the projecting securing members, since the shape of the insert was not significant to the invention of the patent. The securing members and the corresponding notches in the ram packer, serve to prevent lateral rotation in and horizontal displacement out of the detent when the packer is drawn back from the pipe string.

Thus this one feature of Bishop et. al. serves the two necessary functions, but arrangement requires that the entire ram packer be removed and disassembled to replace the insert and the incidental disclosure of the insert configuration was of no moment to the invention.

It is an advantage of the present invention that the insert is non rotational and replaceable without the necessity of removing the ram packer from the blowout preventer. It is another advantage of the present invention that configuration of the insert is simple and can easily casts or machined from a solid block of material. It is a further advantage that the present ram insert is absent any projection thereon for axially slideable engagement with a ram packer.

SUMMARY OF THE INVENTION

Briefly the present invention is a wear insert for a ram packer of a blowout preventer comprising a sealing surface having a semi-circular face preferably having a radius substantially equal to the pipe against which it is to be used and a ram packer mounting surface having a multi sided configuration and having an absence of any projection thereon for axially slidable engagement with a ram packer. The present insert is adapted for lateral insertion in to a corresponding and conforming depression in the packer face.

The present invention also comprises a ram packer of an elastomeric material such as heavy rubber having a recessed slot or cutout configured to conform to and receive said wear insert of, for example a similar or different elastomeric material, and the combination of said ram packer and said insert.

The wear insert has an insertion surface around the periphery which engages in the recessed slot or cutout of the ram packer. To prevent rotation of the wear insert as it engages the pipe, the configuration of the insertion surface is multi sided around the periphery and is engaged by a matching shape of the slot or cutout in the ram packer.

DESCRIPTION OF THE PREFERRED EMBODIMENTS

Figure 1:
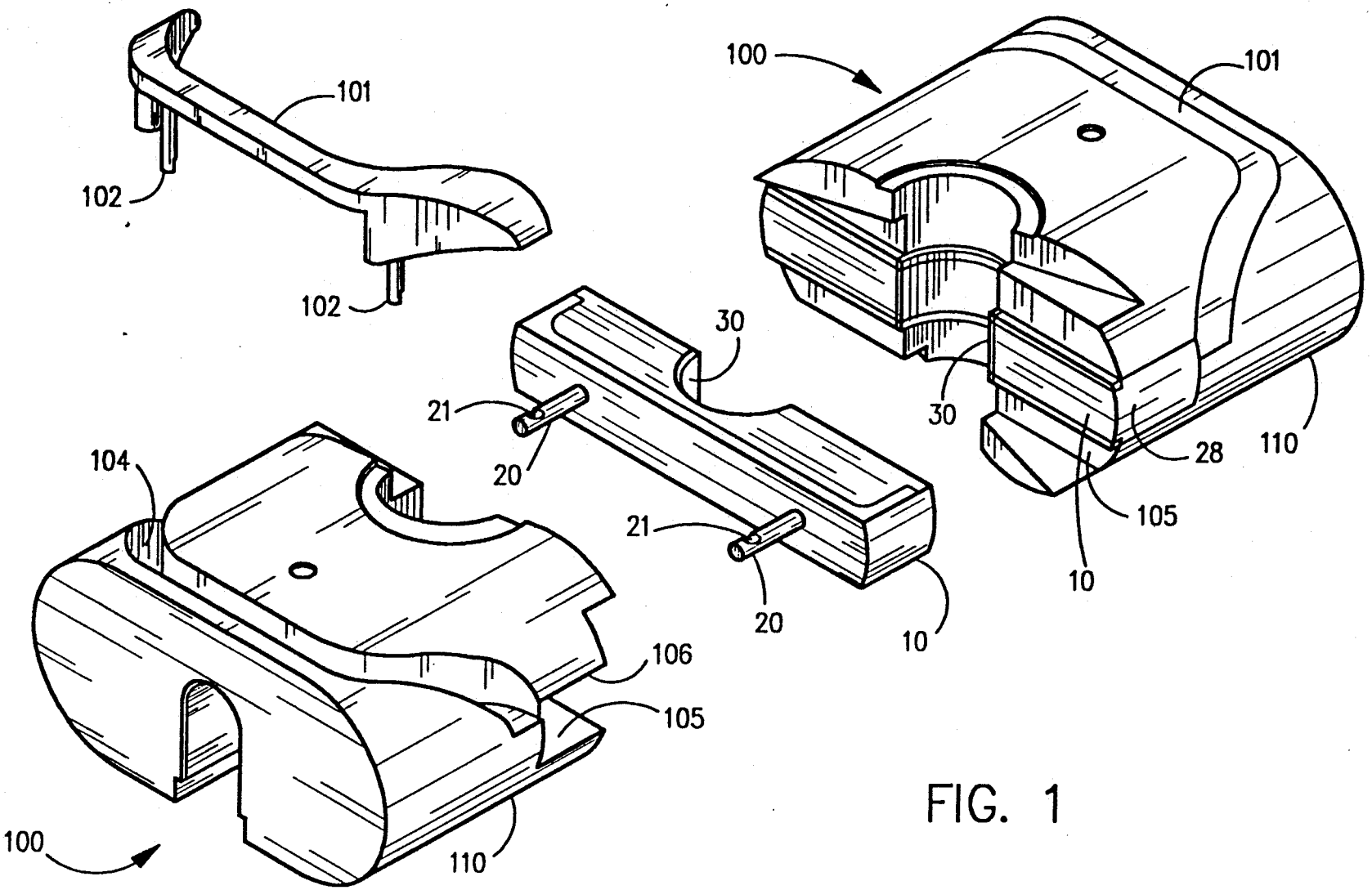
FIG. 1 is an exploded view of a typical blowout preventer ram assembly utilizing the ram packer with wear insert of the present invention.
Figure 3:
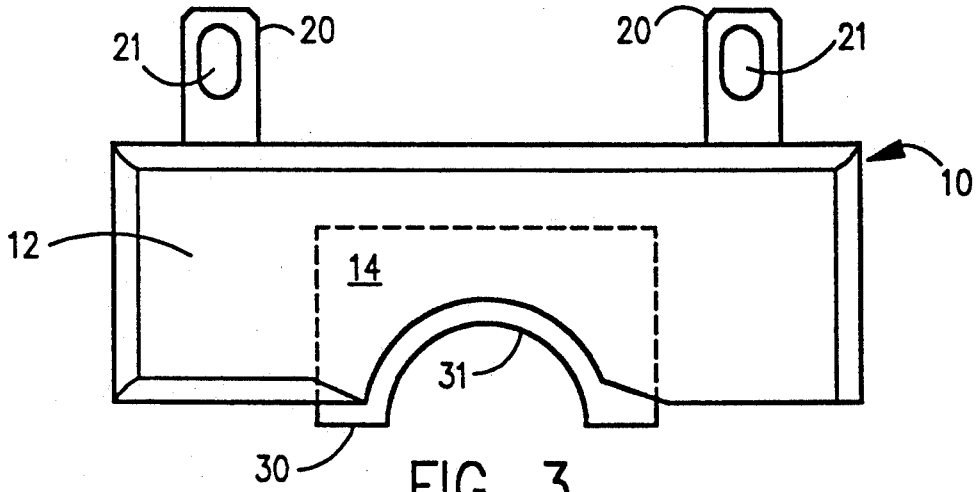
FIG. 3 is a top plan view of the ram packer and wear insert.
Figure 2:
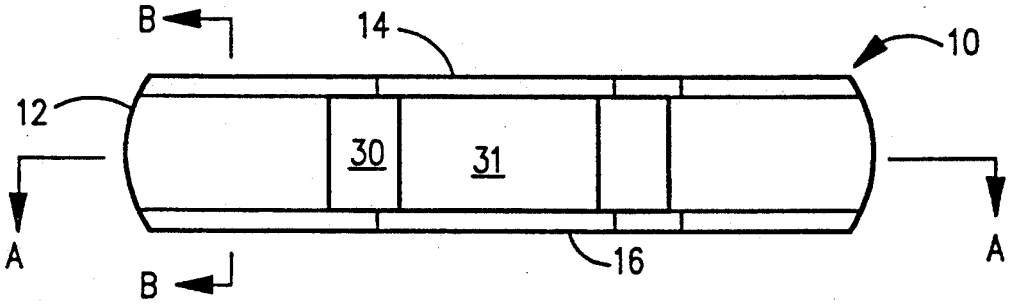
FIG. 2 is a front plan view of the ram packer and wear insert.
Figure 4:
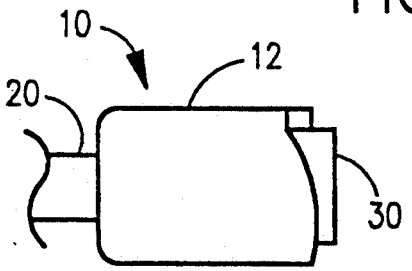
FIG. 4 is a left side plan view of the ram packer and wear insert.
Figure 5:
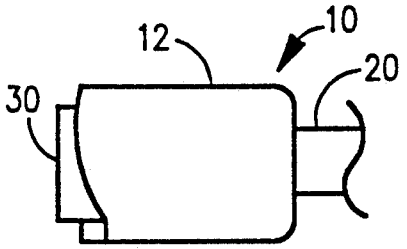
FIG. 5 is a right side plan view of the ram packer and wear insert.

Referring first to FIG. 1 there is shown a typical ram type blowout preventer ram assembly 100 which can utilize the ram packer 10 and wear insert 30 of the present invention. The ram assembly includes body 110 ram packer 10 positioned in recess 28 and packing seal 101 which is positioned in a groove 104 in body 110 that extends along the sides and across the top of body 110 and seal 101 seals against ram packer 10 and the interior of the ram housing (not shown).

Referring now to FIGS. 2–5 there is shown the ram packer 10 with the wear insert 30 in place. The ram packer is seen to comprise packer body 12 of a heavy elastomeric material such as butyl rubber which acts as a reservoir to distribute the force generated by the hydraulic ram evenly about the wear insert 30. Wear insert 30 fits snugly into recess between 14 and 16 and may be made of various materials depending upon the service in which the ram packer is to be used. Extending from the rear of the ram packer are lugs 20 with slots 21 which are engaged by pins 102 on seal 101 when the ram packer 10 is inserted into body 110 (FIG. 1).

Figure 6:
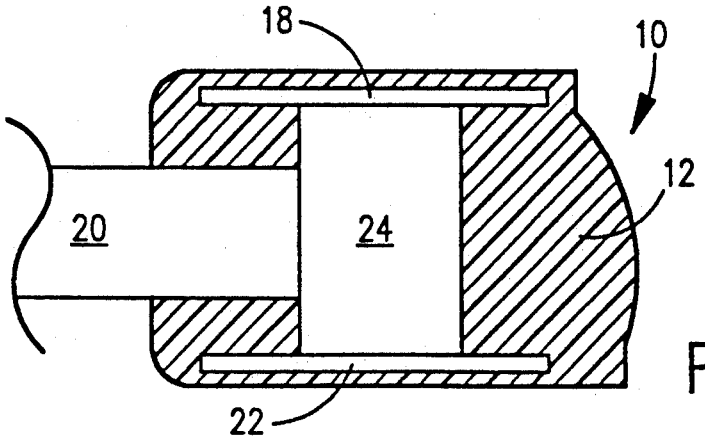
FIG. 6 is right side view in cross section taken along line B—B of FIG. 2.

FIG. 6 shows the construction of a ram packer 10 in side cross section. Two plates 18 and 22 are disposed in parallel relation to each other and spaced apart and secured together by rods 24 (only one shown in FIG. 6). Lugs 20 are connected to 24 as by threads (not shown). The hard elastomeric body 12 is then molded about the construction and includes the wear insert recess (not shown in FIG. 6).

Figure 10:
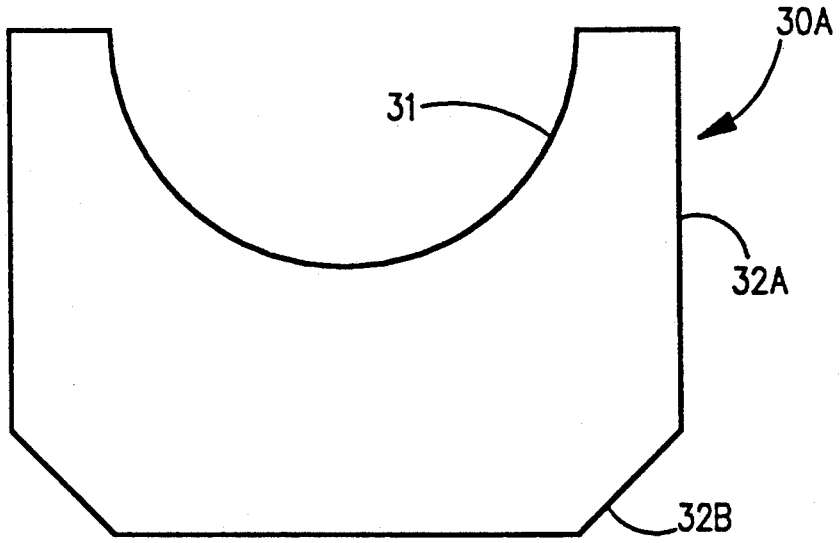
FIG. 10 is a top plan view of a second embodiment of the wear insert of the present invention.
Figure 9:
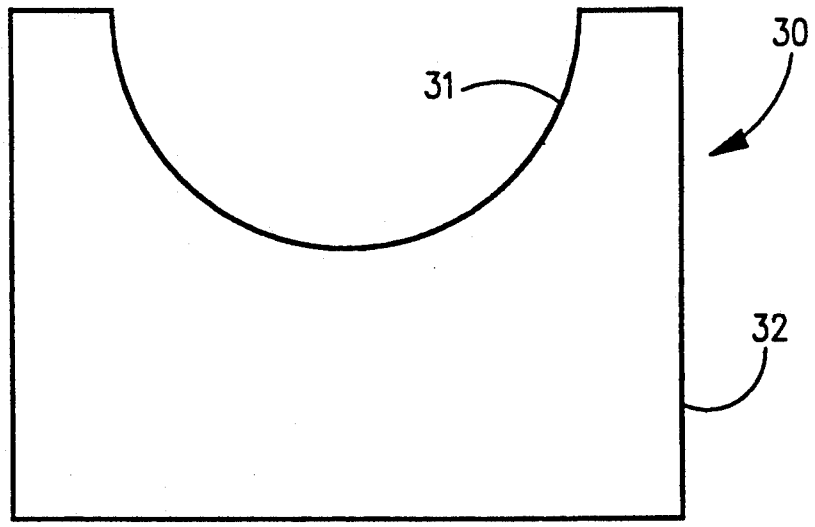
FIG. 9 is a top plan view of one embodiment of the wear insert of the present invention.

Two different embodiments of the wear insert 30 or are shown in FIGS. 9 and 10 (top plan views) to include a sealing surface 31 and an insertion surface 32 or 32A. Sealing surface 31 is semi-circular in shape and is selected to have substantially the same radius as the pipe being used in drilling operations. Insertion surface 32 or 32A extends around the remaining periphery of the wear insert 30. To prevent rotation of the wear insert 30 in the ram packer 10 the insertion surface is preferably multi sided, e.g. square as seen from the top in FIG. 9 or to save material the rear corners may be removed as at 32B in FIG. 10. Additional configurations may also be used so long as a portion of the sides are normal to the front and parallel for some length, e.g. triangular, rectangular, hexagonal, octagonal or the like.

Figure 7:
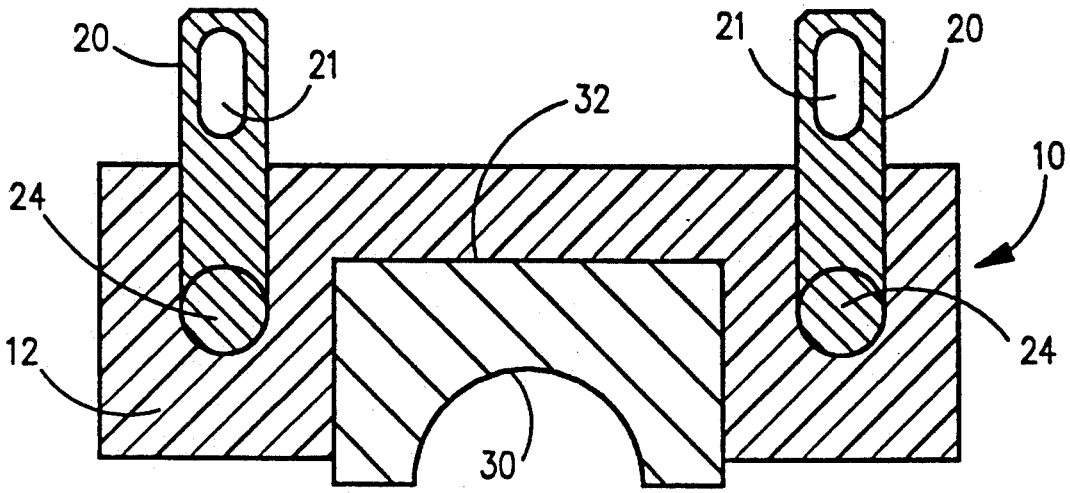
FIG. 7 is a top view in cross section taken along line A—A in FIG. 2 of the embodiment of FIG. 3.
Figure 8:
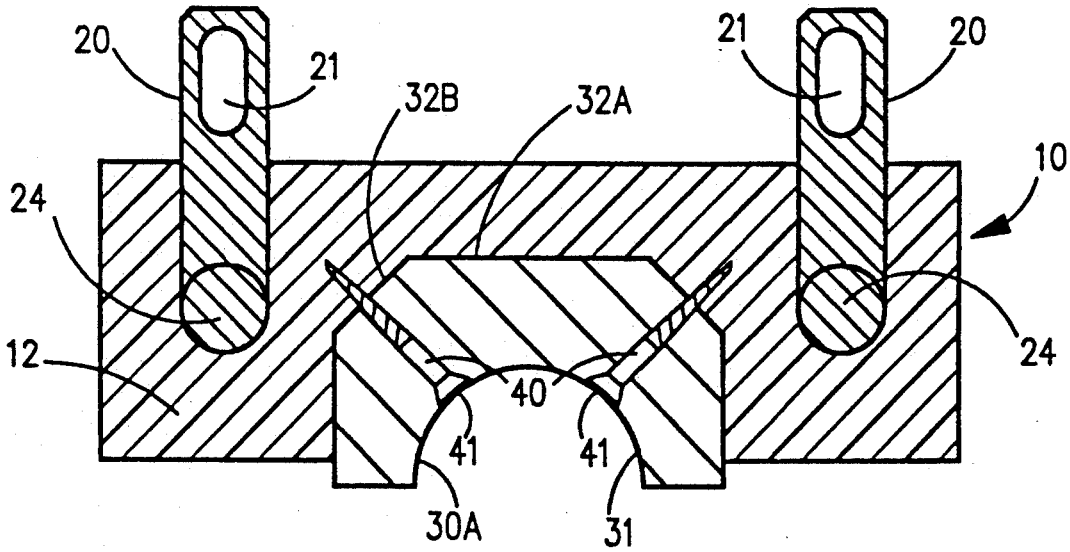
FIG. 8 is a top view in cross section taken along line A—A in FIG. 2 of the embodiment of FIG. 4.

Referring now to FIGS. 7 and 8 top cross sectional views of two embodiments of the wear inserts 30 or 30A are shown inserted within the ram packer 10. The insertion surfaces 32 should fit snugly into a matching recess within the ram packer. Preferably the wear insert is held in recess by radial screws 40 of soft brass mounted and counter set in openings 41 on the seal surface of the insert to prevent lateral movement within the recess.

The present inserts omit any projection on the seating surface that can not seat by lateral insertion in to the recess in the ram packer. It is this omission that allows the removal and replacement of the insert while the packer is still engaged in the blowout preventer.

The invention claimed is:

1. A wear insert for a ram packer of a blowout preventer comprising (a) a sealing surface having a semi-circular face and (b) a ram packer mounting surface having a multi-sided configuration for axially sideable engagement with a ram packer and having an absence of any projection thereon.

2. The insert according to claim 1 wherein said packer mounting surface comprises a rectangular configuration.

3. The insert according to claim 1 wherein said packer mounting surface comprises a hexagonal configuration.

4. The insert according to claim 1 wherein said insert is comprised of an elastomeric material.

5. The combination comprising a ram packer of an elastomeric material having a recessed slot or cutout configured to conform to and receive a wear insert for a ram packer of a blowout preventer comprising:

(a) a sealing surface having a semi-circular face having a radius equal to the pipe against which it is to be used (b) a ram packer mounting surface having a multi sided configuration for axially sideable engagement with a ram packer and having an absence of any projection thereon.

6. The combination according to claim 5 wherein said ram packer mounting surface has a rectangular configuration.

7. The combination according to claim 5 wherein said ram packer mounting surface has an hexagonal configuration.

8. The combination according to claim 5 wherein said wear insert is comprised of an elastomeric material.

9. The combination according to claim 5 wherein ram shoe is comprised of heavy rubber.

10. A ram packer for use in a hydraulic blowout preventer comprising:

(a) a body of hard elastomeric material having attachment means on the rear for attachment to a hydraulic ram and a packer surface opposite said attachment means;

(b) a recess in said packer surface for receiving a replaceable wear insert, said recess defining a substantially multi sided shape toward the rear thereof; and (c) a replaceable wear insert for disposition within said recess including a sealing surface for engagement with a drill pipe and insertion surface which conforms in shape to said recess for lateral insertion and removal.

11. The ram packer according to claim 10 wherein said body further comprises two parallel placed retained in spaced relation with one another by two rods and said hard elastomeric material is molded about said plates and rods.

12. The ram packer according to claim 11 wherein said attachment means comprises a pair of lugs extending from the rear of said body, one each of said lugs being connected to one each of said rods.

13. The ram packer according to claim 12 wherein said heavy elastomeric material is butyl rubber.

14. The ram packer according to claim 13 wherein the shape of said recess and said insertion surface comprises at least two parallel surfaces normal to said packer surface.

15. The ram packer according to claim 14 wherein said wear insert, comprises high molecular weight polyethylene.

16. The ram packer according to claim 14 wherein said wear insert comprises TEFLON.

17. The ram packer according to claim 10 wherein said heavy elastomeric material is butyl rubber.

18. The ram packer according to claim 10 wherein said wear insert comprises high molecular weight polyethylene.

19. The ram packer according to claim 10 wherein said wear insert comprises TEFLON.

20. The ram packer according to claim 10 wherein the shape of said recess and said insertion surface comprises at least two parallel surfaces normal to said packer surface.

* * * * *